US007878925B2

(12) United States Patent
Ogawa

(10) Patent No.: US 7,878,925 B2
(45) Date of Patent: Feb. 1, 2011

(54) GOLF CLUB HEAD

(75) Inventor: Atsushi Ogawa, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 75 days.

(21) Appl. No.: 11/330,866

(22) Filed: Jan. 11, 2006

(65) Prior Publication Data

US 2006/0189406 A1 Aug. 24, 2006

(30) Foreign Application Priority Data

Feb. 23, 2005 (JP) ..... 2005-046960

(51) Int. Cl.
*A63B 53/04* (2006.01)

(52) U.S. Cl. ..... 473/342; 473/349

(58) Field of Classification Search ..... 473/324–350
See application file for complete search history.

(56) References Cited

U.S. PATENT DOCUMENTS

| | | | | |
|---|---|---|---|---|
| 5,346,217 | A * | 9/1994 | Tsuchiya et al. | 473/345 |
| 5,411,614 | A | 5/1995 | Ogawa et al. | |
| 6,193,614 | B1 * | 2/2001 | Sasamoto et al. | 473/329 |
| 7,137,907 | B2 * | 11/2006 | Gibbs et al. | 473/329 |
| 7,169,059 | B2 * | 1/2007 | Rice et al. | 473/329 |
| 7,207,898 | B2 * | 4/2007 | Rice et al. | 473/329 |
| 2002/0065146 | A1 | 5/2002 | Kusomoto | |
| 2002/0091015 | A1 | 7/2002 | Seki et al. | |
| 2004/0078955 | A1 | 4/2004 | Matsunaga | |
| 2005/0051245 | A1 | 3/2005 | Fukai et al. | |

FOREIGN PATENT DOCUMENTS

| | | | |
|---|---|---|---|
| EP | 0 408 313 | A1 | 1/1991 |
| EP | 0 663 453 | A1 | 7/1995 |
| EP | 0 716 155 | A1 | 6/1996 |
| JP | 58-025465 | A | 2/1983 |
| JP | 59-082101 | A | 5/1984 |
| JP | 05-295502 | A | 11/1993 |
| JP | 08-027552 | A | 1/1996 |
| JP | 08-103831 | A | 4/1996 |
| JP | 10-306335 | A | 11/1998 |
| JP | 11244427 | A * | 9/1999 |
| JP | 2003-038690 | A | 2/2003 |

OTHER PUBLICATIONS

McCallister, Jr., William. Materials Science and Engineering. New York: John Wiley & Sons, Inc., copyright 1997, pp. 51 and 52.*

M. Moriga et al., "Hot Bar Rolling of Ti-6A1-4V in a Continuous Mill," *Titanium '92 Science and Technology,* vol. II, pp. 1543-1549 (1993).

Peter Black, Strength of Materials, A Course for Students, 1966. pp xi, xii and 1-7, Pergamon Press Ltd., London.

* cited by examiner

*Primary Examiner*—Alvin A Hunter
(74) *Attorney, Agent, or Firm*—Holtz, Holtz, Goodman & Chick, PC

(57) ABSTRACT

Provided is a golf club head which has the coefficient of restitution within the regulated range and which is easy for hitting balls. The ball-hitting face is made of a material anisotropic in Young's modulus. Preferably the direction of the largest Young's modulus on the face material is perpendicular to the horizontal direction on the face.

3 Claims, 2 Drawing Sheets

GOLF CLUB HEAD

TECHNICAL FIELD

The present invention relates to a golf club head, and specifically to a golf club head having an improved face.

BACKGROUND ART

Golf club head preferably has: low stiffness in view of attaining high restitution; high fatigue strength in view of durability, and small density of the material thereof in view of reducing weight. Responding to these requirements, titanium alloy-made golf clubs are widely used in recent years, (refer to Patent Document 1).

The stiffness of the club head expresses the restitution force at impact of ball. Accordingly, lower stiffness attains longer driving distance owing to what is called the "spring-like effect". Since the stiffness of the face is proportional to cube of the face thickness, thinner face is preferable.

Since the face has to have a certain level of fatigue strength to endure the deflection of the face at impact of ball, higher fatigue strength is preferable. With a material having high fatigue strength, the club head allows longer driving distance without face-damage caused by ball.

From the point of maneuverability of a golf club, lower density of the material for the face is preferable. When the weight of the face portion is large, the center of gravity of the club head moves toward the face, which narrows the area of what is called the "sweet spot".

In the above-described circumstance, the golf clubs which allow longer driving distance than ever have been widely distributed in recent years. As a result, the golf game which should be a competition of skill of players significantly depends on the superiority of tools. The tendency might loose the attractiveness of the golf game as a competition. Responding to the movement, there has been decided to regulate the coefficient of restitution (COR) of the club head to 0.83 or below from 2008, (the restriction has already been enforced for the tournaments of pro-golfers).

If that small coefficient of restitution is to be satisfied by existing materials, however, the face has to become thicker, which increases the club head weight and moves the center of gravity of the club head toward the face, thereby raising a problem of maneuverability.

With the above-described background, a golf club head which is further easy-to-hit while suppressing the increase in the coefficient of restitution is wanted. That type of club head is, however, not developed.

Patent Document 1: Japanese Patent. Laid-Open No. 2003-38690

DISCLOSURE OF THE INVENTION

The present invention has been completed responding to the above-described circumstance, and an object of the present invention is to provide a golf club head which has a coefficient of restitution not higher than the regulated value and which is easy-to-hit one.

The inventor of the present invention conducted studies to solve the above problems, and have derived the following findings.

(a) To realize an easy-to-hit club head while suppressing the increase in the coefficient of restitution, increase of the stiffness of the material thereof is effective.

(b) Creation of anisotropy in Young's modulus in the material of club face increases the stiffness compared with the material having non-anisotropy therein, and higher stiffness is attained particularly by aligning the direction of high Young's modulus perpendicular to the horizontal direction on the face.

(c) With cross-rolling which is generally adopted by ($\alpha$-$\beta$) titanium alloys, Young's modulus becomes almost isotropic. By applying substantially unidirectional rolling, however, a significant anisotropy appears in Young's modulus, thereby giving the largest Young's modulus in perpendicular direction to the rolling direction or to the principal rolling direction.

(d) From the point of creation of anisotropy in Young's modulus and the point of securing necessary strength, the ($\alpha$-$\beta$) titanium alloys are effective.

The present invention has been completed on the above findings, and the present invention provides the following (1) to (6).

(1) A golf club head having a ball-hitting face made of a material anisotropic in Young's modulus.

(2) The golf club head according to (1), giving the direction of the largest Young's modulus of the face material perpendicular to the horizontal direction on the face.

(3) A golf club head having a ball-hitting face made of a rolled sheet prepared by rolling substantially in one direction so as the principal rolling direction to become the horizontal direction on the face.

(4) The golf club head according to any of (1) to (3), wherein the face material is a titanium alloy.

(5) The golf club head according to (4), wherein the face material is an ($\alpha$-$\beta$) titanium alloy.

(6) The golf club head according to (5), wherein the titanium alloy consisting essentially of, as % by mass, 3.5 to 5.5% Al, 2.5 to 3.5% V, 1.5 to 2.5% Fe, 1.5 to 2.5% Mo, 0.25% or less O, and balance of Ti and inevitable impurities.

Since the present invention adopts a material anisotropic in Young's modulus as the face for hitting balls, the stiffness of the face increases compared with a material non-anisotropic in Young's modulus, thereby suppressing the coefficient of restitution without increasing the face thickness, and realizing a golf club head which has small coefficient of restitution, light in weight, and is easy for hitting balls. In particular, by selecting the direction of the largest Young's modulus in the material structuring the face to perpendicular to the horizontal direction on the face, the stiffness of the face further increases, and the weight of the club head further decreases. Specifically, when the ball-hitting face is structured by a rolled sheet prepared by rolling substantially only in one direction, typically only in one direction (unidirectional rolling), while the principal rolling direction becomes horizontal direction on the face, the direction of the largest Young's modulus becomes perpendicular to the horizontal direction on the face, thereby attaining a golf club head having small coefficient of restitution and light in weight.

Figure 1:
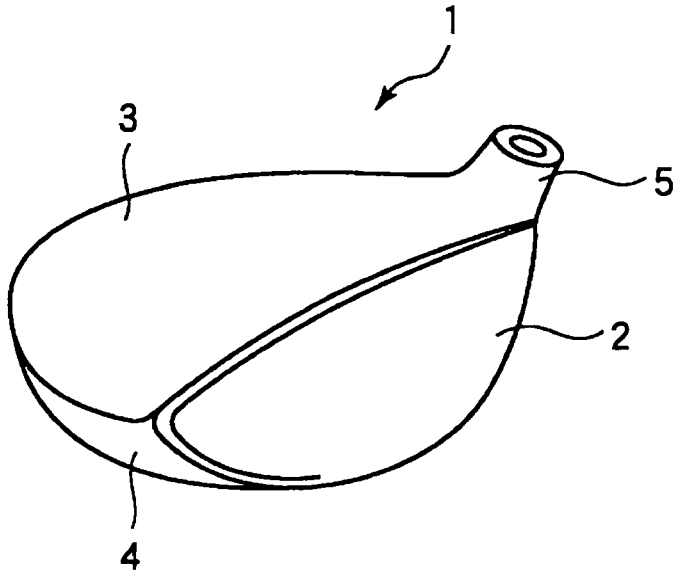
FIG. 1 is a schematic drawing of golf club head.

Reference symbols in FIG. 1 are:

1: golf club head
2: face
3: crown
4: sole
5: hosel

BEST MODE FOR CARRYING OUT THE INVENTION

The embodiments of the present invention are described below in detail.

FIG. 1 shows a perspective view of the golf club head of an embodiment of the present invention. The golf club head 1, (hereinafter referred also to "head"), has a face 2 which hits ball, a crown 3 which extends from the top end of the face 2 and which forms the top of the head 1, a sole 4 which forms the bottom of the head 1, and a hosel 5 which connects a shaft.

The face 2 is made of a metal or an alloy, typically a titanium alloy, and is anisotropic in Young's modulus. Preferably the face 2 has the direction of the largest Young's modulus perpendicular to the horizontal direction thereof. The perpendicular to the horizontal direction referred to herein is not limited to the complete perpendicular direction but allowing approximately ±15° from the perpendicular direction. Within the range, Young's modulus can be increased from that of other directions.

With that anisotropy in Young's modulus, the stiffness of the face 2 can be increased compared with the conventional face which is substantially isotropic in Young's modulus, thereby allowing the coefficient of restitution to decrease.

The (α-β) titanium alloy sheet which is widely used as the material of conventional head is manufactured by cross-rolling that conducts rolling in orthotropic two-directions. Therefore, when that type of material is used for the face, Young's modulus becomes substantially isotropic. By giving an isotropy in Young's modulus, however, the stiffness can be increased from the conventional one, as described above.

To provide the anisotropy in Young's modulus, it is effective to adopt a sheet which was rolled in substantially one direction, typically a sheet which was rolled in only one direction (unidirectional rolling). To make the direction of the largest Young's modulus of the material perpendicular to the horizontal direction on the face 2, the principal rolling direction of that type of rolled sheet is brought to the horizontal direction on the face 2.

A preferable material of the face 2 is a titanium alloy which is the typical head material and which is most widely applied thereto. However, other than the titanium alloys, materials such as composite materials are also effective. Since titanium alloys have high strength, though they have low density compared with steel and other metals, they can decrease the weight of the head. In addition, owing to the high fatigue strength, titanium alloys give high durability. Compared with general metals and alloys, composite materials give large anisotropy in Young's modulus for their density. In addition, filament composite materials have larger anisotropy in Young's modulus. Therefore, both the titanium alloys and the composite materials are highly preferable to achieve the object of the present invention.

As of titanium alloys, (α-β) titanium alloys are preferable. The (α-β) titanium alloys are easier to provide anisotropy in Young's modulus while maintaining sufficient strength than β titanium alloys.

A preferable (α-β) titanium alloy contains, as % by mass, 3.5 to 5.5% Al, 2.5 to 3.5% V, 1.5 to 2.5% Fe, 1.5 to 2.5% Mo, 0.25% or less O, and balance of Ti and inevitable impurities. That type of titanium alloy has high strength, specifically fatigue strength, so that it is highly preferable as the material of golf club face.

That type of titanium alloy can be manufactured by heating the starting material having the above composition to a temperature between (β-transus temperature −250° C.) and the β-transus temperature, and then by applying hot-working such as hot-forging, hot-rolling, and hot-extruding at reduction in thickness of 50% or more, preferably 75% or more.

The following is the description about the result of determination of the relation between the rolling direction and Young's modulus using titanium alloys having the compositions within the above range, and about the result of finite element analysis (FEM analysis) to determine the relation between the anisotropy in Young's modulus and the stiffness of the face.

The applied materials were the unidirectionally rolled titanium alloy sheets having above range of compositions. Young's modulus (modulus of direct elasticity) and Poisson's ratio were determined in: the rolling direction, (L direction); the lateral direction to the rolling direction, (T direction); and the 45° direction to the rolling direction, (45° direction). The result is given in Table 1.

Figure 2:
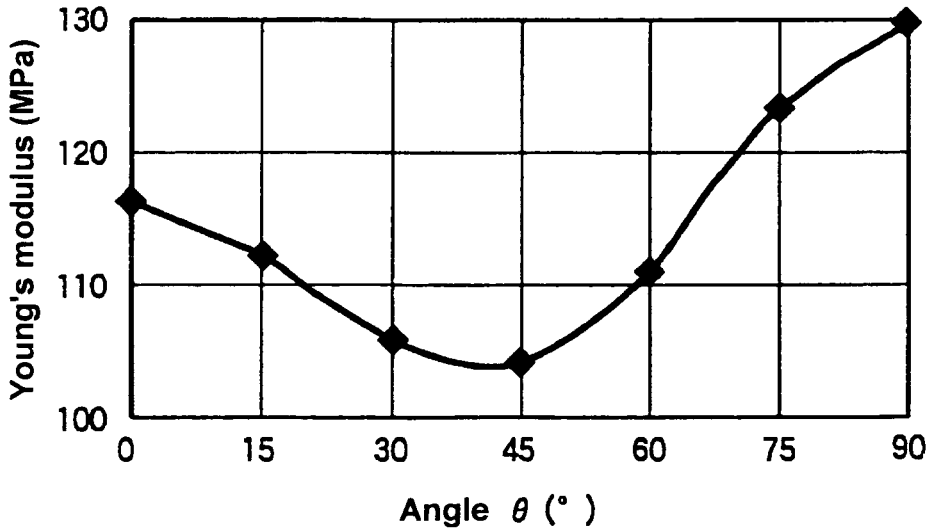
FIG. 2 shows the dependency of the direction of modulus of direct elasticity, (material cutting angle $\theta$), in the orthotropic elastic material model.

The FEM analysis adopted the orthotropic elastic material model which is used in the element model of FEM analysis code ANSYS. As the characteristics of the analysis, the values given in Table 2 were used. The isotropic Young's modulus was 115 GPa. FIG. 2 shows the dependency of the direction of modulus of direct elasticity, (material cutting angle θ) in the orthotropic elastic material model.

Figure 3:
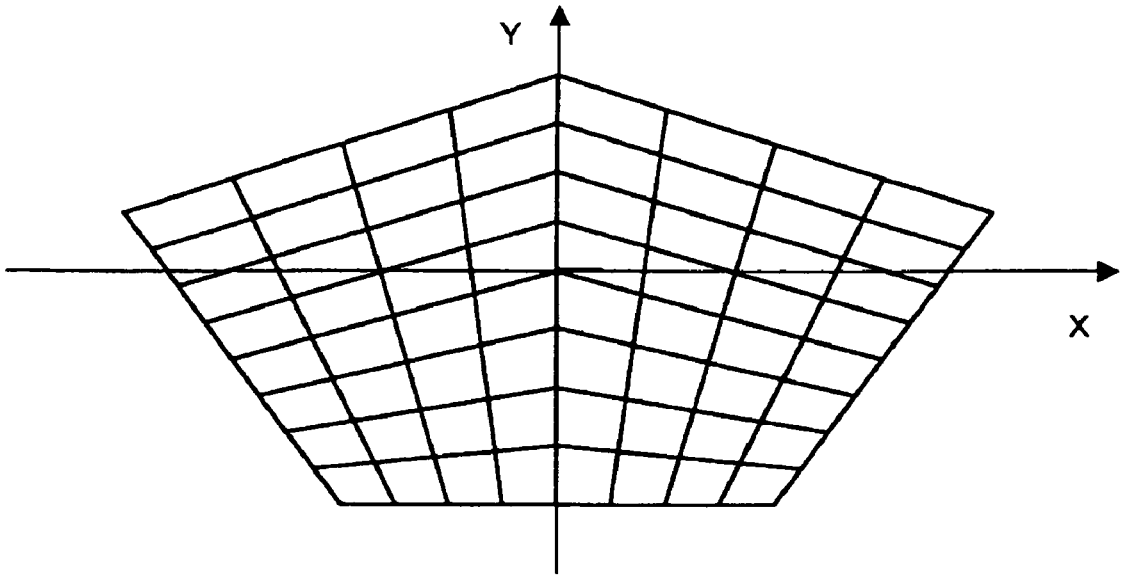
FIG. 3 shows a mesh-diagram used in FEM analysis. The origin is the ball-hitting point.

The FEM analysis model approximated the face to a pentagon. The face had the dimensions of 40 mm in the perpendicular direction to the horizontal direction (Y) on the head and 80 mm in the horizontal direction (X) thereon, and of 3 mm in sheet thickness. The analysis was conducted by the FEM analysis mesh diagram given in FIG. 3. The center of the mesh diagram was the origin corresponding to the ball-hitting point, while the surrounding points are restricted in all displacements. To the ball-hitting point (origin of the X-Y coordinates), a force of 1 Newton (N) was applied in the Z direction, and the displacement in the Z direction, δ, at the point was determined. The stiffness is the value of the force (1 N) divided by the displacement δ.

The stiffness was determined in four cases: isotropic Young's modulus, similar to the conventional cross-rolling, (Case 1); direction of large Young's modulus (perpendicular to the rolling direction) being the horizontal direction on the face, (Case 2); direction of large Young's modulus being perpendicular to the horizontal direction of the face, (Case 3); and direction of large Young's modulus being 45° direction, (Case 4). The result is given in Table 3.

As seen in Table 3, Cases 2 to 4 which were anisotropic in Young's modulus gave larger stiffness than that of Case 1 which was not anisotropic in Young's modulus, giving 1.05 or larger stiffness as a ratio to the level of Case 1. Particularly in Case 3, the stiffness ratio was 1.12 which increased by 12% from Case 1.

As described above, when Young's modulus of the face material has anisotropy, the stiffness becomes larger than that of the conventional cases giving isotropy in Young's modulus, which allows the coefficient of restitution to decrease without increasing the face thickness.

Although the above description was given for the cases of titanium alloys, the present invention is also applicable to metals or alloys other than titanium alloys, and to above-described composite materials.

TABLE 1

| Sampling direction | Young's modulus (GPa) | Poisson's ratio |
|---|---|---|
| L | 116 | 0.393 |
| T | 130 | 0.378 |
| 45° | 104 | 0.308 |

TABLE 2

| Sampling direction | Modulus of direct elasticity (GPa) | Modulus of transverse elasticity (GPa) | Poisson's ratio |
|---|---|---|---|
| L | 116 | 34.8 | 0.385 |
| T | 130 | 34.8 | 0.385 |
| 45° | 104 | 34.8 | 0.385 |

TABLE 3

| Case | Stiffness at ball-hitting point (N/mm) | Stiffness ratio |
|---|---|---|
| 1 | $2.597 \times 10^4$ | 1 |
| 2 | $2.793 \times 10^4$ | 1.08 |
| 3 | $2.915 \times 10^4$ | 1.12 |
| 4 | $2.732 \times 10^4$ | 1.05 |

EXAMPLES

The examples of the golf club head according to the present invention are described below.

A titanium alloy sheet was prepared from a titanium alloy having the composition given in Table 4. The alloy was an (α-β) titanium alloy. The sheet was treated by hot-working of the unidirectional rolling under the condition of 830° C. of heating temperature, 800° C. of rolling start temperature, and 680° C. of rolling end temperature, thereby obtaining a sheet for the face having 3 mm in thickness, as the Example of the present invention. As the Comparative Example, a sheet for the face having 3 mm in thickness was prepared by applying hot-working of the cross-rolling under the same rolling conditions as above, such as working temperature, rolling start temperature, and rolling end temperature.

With the composition (Table 4), the stiffness and the coefficient of restitution were determined on each of the Comparative Example which used the conventional sheet prepared by cross-rolling and the Example of the present invention which used the sheet having anisotropy in Young's modulus created by the unidirectional rolling, and having the direction of large Young's modulus in the perpendicular direction to the horizontal direction on the face.

The stiffness was determined by the strain gauge method conforming to the following procedure.

Each of the titanium alloy sheets of the Example and the Comparative Example, prepared by the above respective methods, was cut to obtain test piece (6 cm×10 cm) so as the longitudinal length thereof (10 cm) to become parallel to the rolling direction. Strain gauges were attached to the center of the test piece. The test piece was fixed to a rectangular frame having the same dimensions to those of the test piece. Successive hitting of golf balls was given against the center of the test piece at a speed of 45 m/sec, and the output of the strain gauges was observed.

The coefficient of restitution was determined by the method specified in Rule 4-1e of the United States Golf Association (USGA) With the titanium alloy sheet prepared by the above method, (Example of the present invention), the golf club head of the Example of the present invention was fabricated by arranging the horizontal direction of the face in parallel to the rolling direction, and the golf club head of the Comparative Example was fabricated by the cross-rolling method. The coefficient of restitution (COR) was determined for both the heads. The coefficient of restitution is "e" in equation (1) which determines the speed ratio ($V_{out}/V_{in}$), ($V_{out}$ is the head speed after hitting, and $V_{in}$ is the head speed before hitting), $$V_{out}/V_{in}=(eM-m)/(M-m) \quad (1)$$

where, M is the mass of club head and m is the average mass of ball.

The test result is given in Table 5. As shown in Table 5, the Example improved the stiffness by 14% compared with the Comparative Example. The value almost corresponds to the result of the FEM analysis (Table 2), which proved that the Example of the present invention is effective in improving the stiffness.

The coefficient of restitution of the golf club head according to the present invention was 0.82, which satisfied the standard of USGA. To the contrary, the coefficient of restitution of the golf club head of the Comparative Example was 0.84. As given in the comparison, the Example is able to decrease the coefficient of restitution to 0.83 (the standard value) or smaller compared with that in the conventional head without increasing the face thickness.

TABLE 4

| (mass %) | | | | |
|---|---|---|---|---|
| AI | V | Fe | Mo | O |
| 4.4 | 3.1 | 1.9 | 2.1 | 0.14 |

TABLE 5

| | Stiffness ratio | Coefficient of restitution (COR) |
|---|---|---|
| Example of the invention | 1.14 | 0.82 |
| Comparative Example | 1 | 0.84 |

The invention claimed is:

1. A golf club head having a ball-hitting face made of a material anisotropic in Young's modulus;

wherein the ball-hitting face is made of a rolled sheet of an (α-β) titanium alloy;

wherein the anisotropy in Young's modulus is produced by rolling the (α-β) titanium alloy substantially in only one principal rolling direction;

wherein the principal rolling direction becomes a long-dimension direction on the ball-hitting face, which is a horizontal direction of the ball-hitting face, wherein the Young's modulus of the material is largest along a short-dimension direction on the ball-hitting face that is within −15° to +15° of a direction perpendicular to the horizontal direction of the ball-hitting face; and wherein no ribs are provided on a rear side of the ball-hitting face.

2. The golf club head as in claim 1, wherein the titanium alloy consists essentially of, as % by mass, 3.5 to 5.5% Al, 2.5 to 3.5% V, 1.5 to 2.5% Fe, 1.5 to 2.5% Mo, 0.25% or less O, and balance of Ti and inevitable impurities.

3. The golf club head as in claim 1, wherein the golf club head has a coefficient of restitution of not more than 0.83.

* * * * *